US008033061B2

(12) United States Patent
Hrazdjira

(10) Patent No.: US 8,033,061 B2
(45) Date of Patent: Oct. 11, 2011

(54) SALES AND PRESENTATION AREA WITH ROTATABLY MOUNTED ANNULAR REGION DIVIDED INTO VERTICALLY MOVABLE RING SEGMENTS

(76) Inventor: Guenter Hrazdjira, Vienna (AT)

( * ) Notice: Subject to any disclaimer, the term of this patent is extended or adjusted under 35 U.S.C. 154(b) by 0 days.

(21) Appl. No.: 12/583,503

(22) Filed: Aug. 21, 2009

(65) Prior Publication Data

US 2010/0024312 A1 Feb. 4, 2010

Related U.S. Application Data

(63) Continuation-in-part of application No. 10/519,315, filed as application No. PCT/AT2003/000155 on May 28, 2003, now abandoned.

(30) Foreign Application Priority Data

Jun. 27, 2002 (AT) ..... A 965/2002

(51) Int. Cl.
*E04B 1/346* (2006.01)
*E04H 3/02* (2006.01)

(52) U.S. Cl. ..... 52/65; 52/236.2

(58) Field of Classification Search ..... 52/7, 9, 52/79.1, 79.4, 234, 236.2, 236.3, 29, 31, 52/64, 65; 472/75, 76
See application file for complete search history.

(56) References Cited

U.S. PATENT DOCUMENTS

| | | | |
|---|---|---|---|
| 2,182,757 | A | 12/1939 | Gilbert |
| 2,764,783 | A | 10/1956 | Teller |
| 3,469,837 | A | 9/1969 | Heilig |
| 4,305,117 | A | 12/1981 | Evans |
| 5,365,704 | A | 11/1994 | Ray |
| 6,148,568 | A | 11/2000 | Beasley |

FOREIGN PATENT DOCUMENTS

| | | |
|---|---|---|
| DE | 2 318 203 | 10/1974 |
| DE | 93 14 954.9 | 3/1994 |
| DE | 19618238 | 11/1997 |

*Primary Examiner* — Michael Safavi
(74) *Attorney, Agent, or Firm* — Collard & Roe, P.C.

(57) ABSTRACT

A sales and presentation area has an essentially annular region rotatably mounted in the horizontal direction, divided into ring segments able to be moved individually in the vertical direction, and set into horizontal rotational movement via drives during use of the ring segments by customers. A changing section along the path of the moving annular region is kept inaccessible for customers from the exterior of the annular region. A lifting and lowering device is provided beneath the changing section. The ring segments slide over the lifting and lowering device in the course of the rotational movement of the annular region and rest on the lifting and lowering device during a standstill of the annular region for moving the ring segments in the vertical direction. The ring segments may be pushed in the radial direction into rooms below the sales and presentation area.

3 Claims, 3 Drawing Sheets

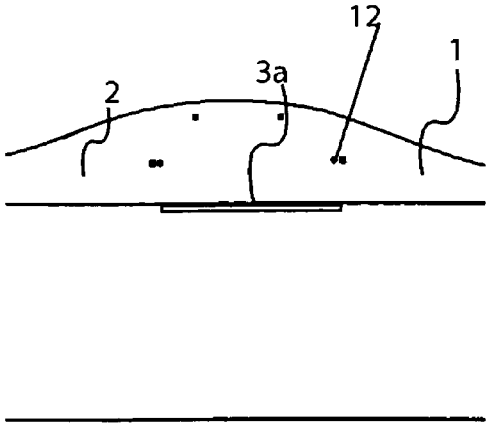
FIG. 3A
FIG. 3B
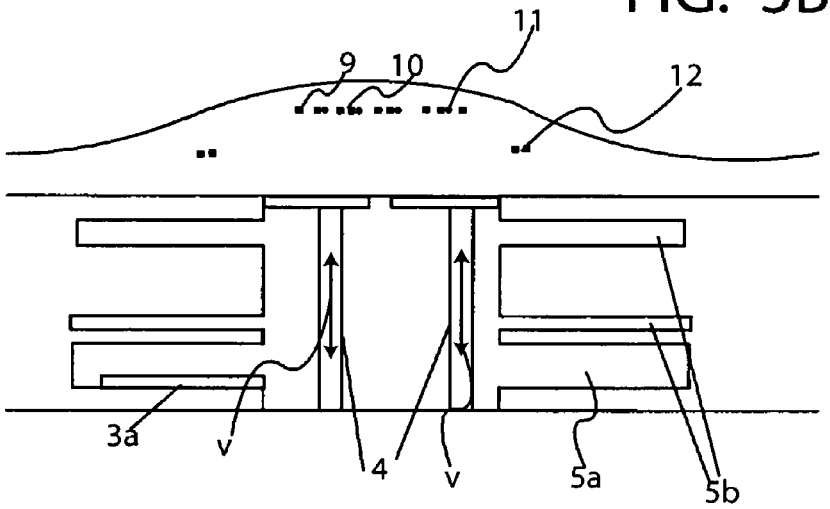
FIG. 3C
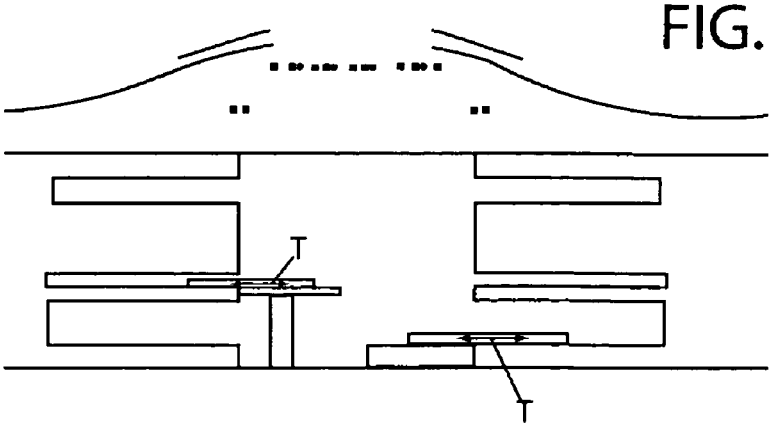

SALES AND PRESENTATION AREA WITH ROTATABLY MOUNTED ANNULAR REGION DIVIDED INTO VERTICALLY MOVABLE RING SEGMENTS

CROSS REFERENCE TO RELATED APPLICATIONS

This is a continuation-in-part of U.S. patent application Ser. No. 10/519,315 filed on Dec. 23, 2004 and now abandoned, which is the National Stage of PCT/AT2003/000155 filed on May 28, 2003, which claims priority under 35 U.S.C. §119 of Austrian Application No. A 965/2002 filed on Jun. 27, 2002. The international application under PCT article 21(2) was not published in English.

BACKGROUND OF THE INVENTION

The present invention relates to a sales and presentation area such as a shopping mall or the like.

In typical sales and presentation areas of this type, the primary intention is to offer the consumers a manifold selection of goods in differently designed sales and presentation regions, which are combined into possibly large-volume sales and presentation areas. It is typical in this case to combine these sales and presentation regions with facilities for gastronomy and entertainment, in order to thus also represent the shopping as an adventure and therefore as a possibility for a recreational activity.

In this case, it is attempted, for example, to draw streams of customers via interesting architectonic design of the sales and presentation area or to awaken the interest of the consumers via diverse events in the freely travelable sections between the individual sales and presentation regions. The operators of the individual sales and presentation regions, in turn, attempt to excite the attention of the customers again and again via a regularly changing design of their individual business regions. "Shopping centers" are thus increasingly turned into "shopping cities", in which shopping is connected with "fun" and "entertainment". However, the selection of sales and presentation areas of this type is increasing and it is becoming more and more difficult to obtain the interest of the consumers. It has been shown to be disadvantageous in this case that the individual sales and presentation regions may be redesigned at a relatively low cost, but the appearance of the entire sales and presentation area may not be changed without something further, so that the effect of familiarity causes increasing disinterest in the consumers.

Furthermore, shopping malls are being increasingly combined with other recreational areas such as sport areas, theatres, gambling areas, and the like. Some of these areas will be used predominantly during day hours, and others during evening and night hours. Thus, some of the sales and presentation regions of the shopping mall may remain unused during most of the day which decreases the revenues of the overall shopping mall.

BRIEF SUMMARY OF THE INVENTION

It is therefore the object of the present invention to avoid these disadvantages and, on the one hand, to ensure a continuously changing appearance of the sales and presentation area via suitable constructive measures, and on the other hand to increase the total time of use of the sales and presentation area.

The invention provides for an annular region, wherein said annular region is rotatably mounted in the horizontal direction, divided into ring segments able to be moved individually in the vertical direction, and set into horizontal rotational movement via drives during use of said ring segments by customers. This annular region represents a freely accessible region, on which the changing streams of customers move between individual sales and presentation regions. If, according to the invention, this freely travelable region is made rotatable, a static appearance is avoided and continuously changing scenery is ensured even if the customers are peacefully resting. The effect of familiarity is thus less likely to occur.

Since the annular region has, in particular, be accessible to design and cleaning work, it is suggested by the invention that the sales and presentation area further comprises

- a changing section along the path of said moving annular region which encompasses at least one of said ring segments during a standstill of said annular region, and which is kept inaccessible for customers from the exterior of said annular region,
- a lifting and lowering device which is provided beneath the changing section and over which said ring segments slide in the course of the rotational movement of said annular region and on which said ring segments rest during a standstill of said annular region for moving said ring segments in the vertical direction, and
- rooms below the sales and presentation area, into which said ring segments may be pushed in the radial direction, if said lifting and lowering device is correspondingly lowered.

In this way, individual ring segments may be supplied to rooms below the sales and presentation area, in which, for example, rebuilding work on the ring segments may be performed. Performing this rebuilding work outside of the sales and presentation area may be advantageous, for example, because the ring segments otherwise would not be accessible to the devices necessary for the renovation work or in order to avoid impairing the sales and presentation area by dust and the like.

It is further possible to replace, e.g., a ring segment which during the day serves for sporting activities such as a squash field by, e.g., a gambling area used during night hours. This makes it possible to use areas of the shopping mall with higher capacity, thereby increasing total revenues of the overall shopping mall. By providing a changing section which can easily be closed for public and, thus, cleared from customers it is further possible to replace ring segments during the opening hours of the sales and presentation area so that, e.g., a shopping mall may be opened 24 hours a day without impairing the possibility to replace ring segments.

According to a further embodiment of the invention, said rooms, into which said ring segments may be pushed in the radial direction, if said lifting and lowering device is correspondingly lowered, are positioned one below another under the sales and presentation area. It is thus possible, for example, to lower a ring segment, push a segment, via a movement in the radial direction, from the lifting and lowering devices into rooms in which, for example, rebuilding work may be conveniently performed, move the lifting and lowering devices vertically so that another ring segment may be pushed onto the lifting and lowering devices from another room, and bring this segment to the height of the sales and presentation area as a temporary replacement.

Of course, it is possible to implement the rotatable annular region according to the present invention in manifold form. According to one embodiment of the invention, a second annular region is located adjacent to said first annular region, said second annular region having an associated second lifting and lowering device, said first and second annular region sharing the same changing section which is kept inaccessible for customers from the exterior of said first and second annular region.

BRIEF DESCRIPTION OF THE SEVERAL VIEWS OF THE DRAWINGS

The present invention is described in the following with reference to the attached drawings, which relates to a possible embodiment of the present invention.

FIG. 3*a* is a cross-sectional view along line 2*a*/2*b*/3*a*/3*b*/3*c*-2*a*/2*b*/3*a*/3*b*/3*c* in FIG. 1 showing the embodiment shown in FIG. 1 in vertical projection and illustrating those sections of the travelable annular regions which are not equipped with a lifting and lowering device, FIG. 3*b* is a cross-sectional view along line 2*a*/2*b*/3*a*/3*b*/3*c*-2*a*/2*b*/3*a*/3*b*/3*c* in FIG. 1 and shows sections of the embodiment of the present invention shown in FIG. 1 in vertical projection and illustrates the changing section of the travelable annular regions which is equipped with a lifting and lowering device in an arrangement which it would be in during use of the annular region by customers, and FIG. 3*c* is a cross-sectional view along line 2*a*/2*b*/3*a*/3*b*/3*c*-2*a*/2*b*/3*a*/3*b*/3*c* in FIG. 1 and shows sections of the embodiment of the present invention shown in FIG. 1 in vertical projection and illustrates the changing section of the travelable annular regions which is equipped with a lifting and lowering device in an arrangement which it would be in during intended rebuilding work on the ring segments.

DETAILED DESCRIPTION OF THE INVENTION

Figure 1:
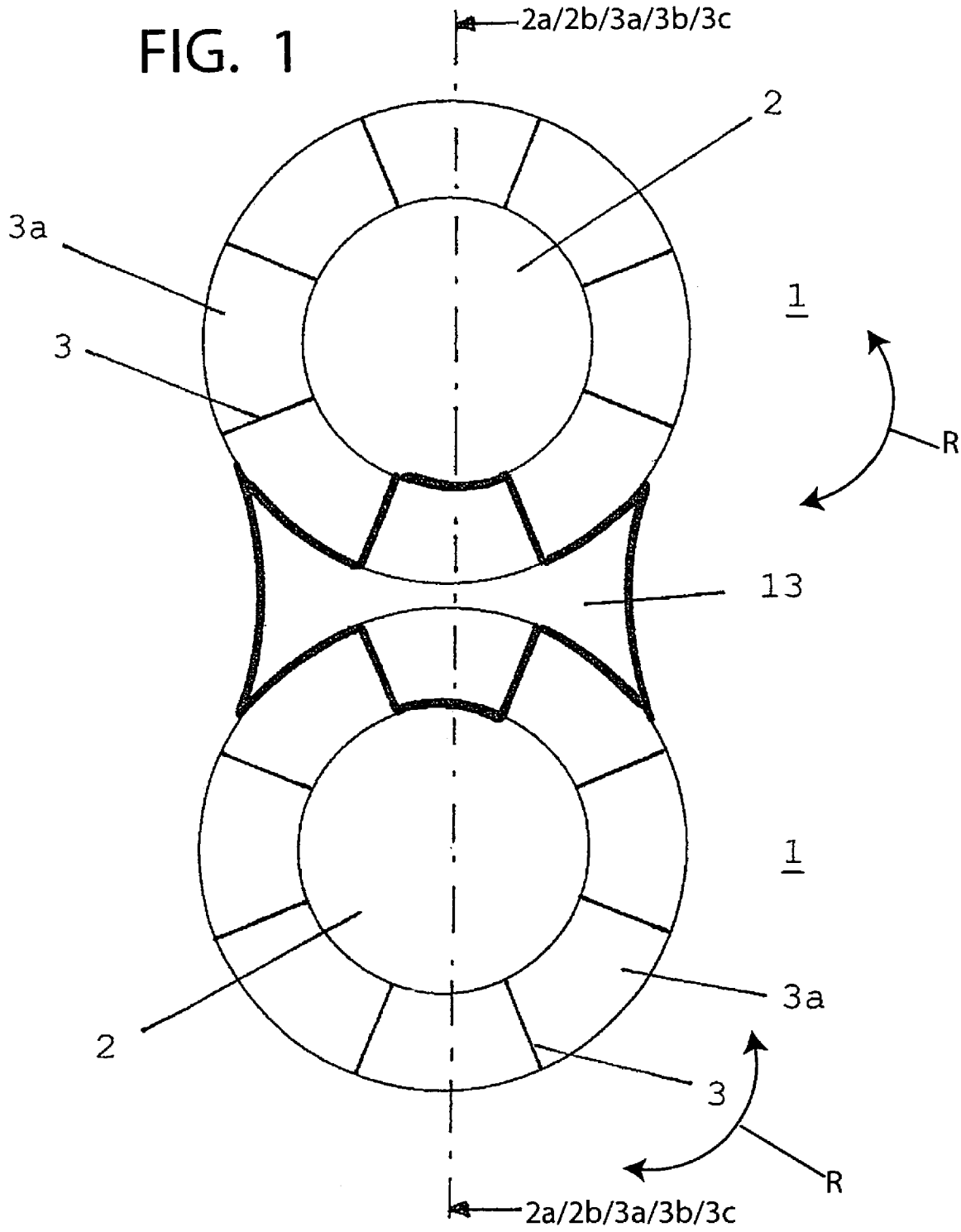
FIG. 1 shows an embodiment of the present invention in horizontal projection.

As may be seen in FIG. 1, individual sales and presentation regions 1, 2 are arranged into parts, a first, outer sales and presentation region 1 at least partially enclosing an essentially circular region, within which second, inner sales and presentation region 2 extends, which at least partially covers an essentially circular region. Therefore, a rotatable annular region 3 is formed between first, outer sales and presentation region 1 and second, inner sales and presentation region 2, on which the changing streams of customers move between individual sales and presentation regions 1, 2. In this case, regions having other uses, such as sanitary facilities, storage rooms, or entrances and exits, may also be located in the outer region, which is defined by first sales and presentation region 1, and in the inner sales and presentation region 2. Annular region 3 is divided into ring segments 3*a* both in regard to its constructive embodiment and in regard to its design. Thus, for example, each segment 3*a* may be designed as its own "adventure world" with the aid of sound, light, and smell effects, as well as the use of different floor coverings, such as wood, stone, or grass floors, reflecting or transparent floors, and floors having bodies of water and the like. Ring segments 3*a* may house gastronomy facilities such as cafes, bars, restaurants, or bistros, facilities such as playgrounds, movie theaters, gambling halls, or theaters, or exhibition regions such as auto presentations, etc.

While no movement ability is provided for sales and presentation regions 1, 2, annular region 3 is mounted so it is rotatable around an axis of rotation 7. This may be performed via drives of different types (not shown), as have been known for a long time in drive technology for revolving stages and the like. The rotational speed is selected so that it corresponds to all legal guidelines, in particular, the use of rotating annular region 3 is also to be easily possible for older people and the handicapped. Since, at a constant angular speed, the local rotational speed on annular region 3 increases with increasing distance from the center of rotation, the optimum angular speed is oriented to both the maximum permissible rotational speed and the outer diameter of annular region 3. For example, if the outer diameter of annular region 3 is 120 m and the inner diameter is 80 m, then at a maximum permissible rotational speed of 2.5 cm/sec., the angular speed selected is to be approximately 1.4 rad/hour, which corresponds to a rotational speed of 1.6 cm/sec. at the inner diameter and 2.4 cm/sec. at the outer diameter of circular ring 3. A complete rotation would therefore be performed in 4 hours and 21 minutes in this exemplary embodiment. It is obvious that the angular speed of rotating annular region 3 selected must be smaller the larger the sales and presentation area is constructed, i.e., the larger the outer diameter of annular region 3 is.

In the embodiment shown in FIG. 1, two annular regions 3 are provided, which nearly come into contact in a changing section 13. For this purpose, respective outer sales and presentation regions 1 will not completely enclose an inner circular region, but will leave out a changing section 13, which is provided with an unmoving floor and which is not accessible to general public. This changing section 13 extends along the path of said moving annular region 3 and encompasses at least one of said ring segments 3*a* during a standstill of said annular region 3. Arrows R indicate the direction of rotation of annular regions 3. Furthermore, according to this embodiment, both annular regions 3 are each provided with a lifting and lowering device 4, such as a lifting stage, which is positioned in changing section 13 of annular regions 3.

Figure 2A:
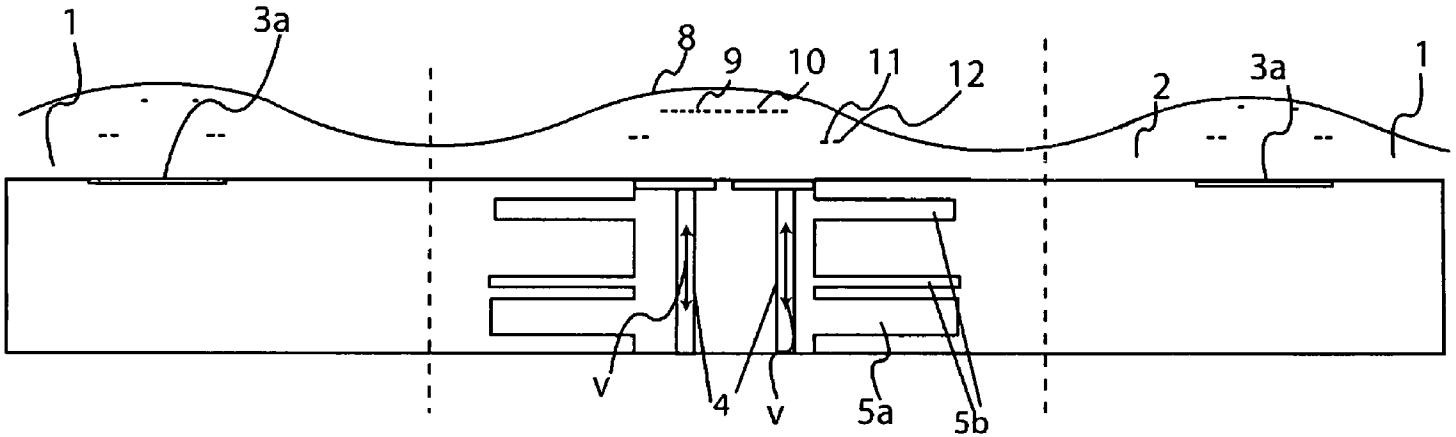
FIG. 2*a* is a cross-sectional view along line 2*a*/2*b*/3*a*/3*b*/3*c*-2*a*/2*b*/3*a*/3*b*/3*c* in FIG. 1 showing the embodiment shown in FIG. 1 in vertical projection and illustrating the device according to the present invention in an arrangement which it would be in during the use of the annular region by customers and FIG. 2*b* is a cross-sectional view along line 2*a*/2*b*/3*a*/3*b*/3*c*-2*a*/2*b*/3*a*/3*b*/3*c* in FIG. 1 showing the embodiment shown in FIG. 1 in vertical projection and illustrating the device according to the present invention in an arrangement which it would be in during intended rebuilding work on the ring segments.
Figure 2B:
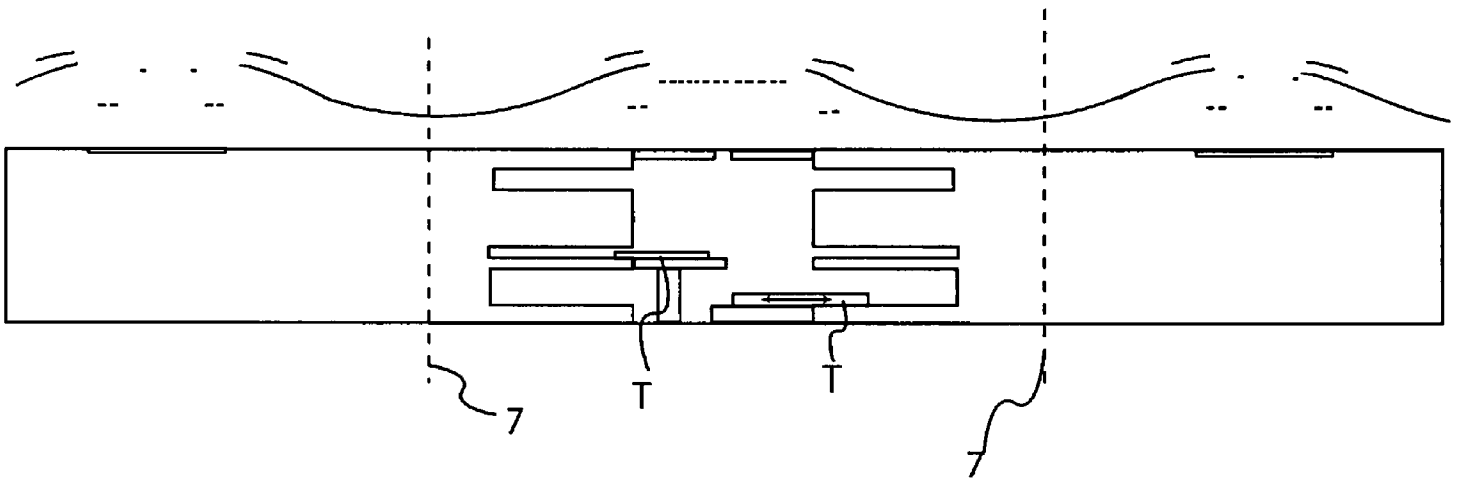

During use of annular regions 3 by customers, annular regions 3 are set into horizontal rotational movement via drives (not shown). Annular regions 3 slide over lifting and lowering devices 4 in this case. If needed, for example, in the event of intended redesign of a specific ring segment 3*a*, the horizontal rotational movement of annular region 3 is stopped in such a way that ring segment 3*a* to be redesigned comes to rest on lifting and lowering device 4 in changing section 13. Alternatively, it may also be possible to design the drives for the horizontal movement of annular region 3 in a way that decoupling of a first ring segment 3*a* and coupling of a replacing second ring segment 3*a* occurs during rotation of annular region 3 without standstill. If there are no customers on ring segment 3*a*, which may also be assured by, e.g., vertically moving walls between two adjacent ring segments 3*a* and warning devices which timely urge customers to leave the corresponding ring segment 3*a*, lifting and lowering device 4 may be activated so that this ring segment 3*a* is lowered as shown in the embodiment of FIG. 1 and supplied to rooms 5*a* below sales and presentation regions 1, 2. Arrow V in FIG. 2*a* and FIG. 3*b* indicate the direction of movement of lifting and lowering device 4. As is shown in FIGS. 2*b* and 3*c*, affected ring segment 3*a* may now be pushed from lifting and lowering device 4 into rooms 5*a*, serving as a rebuilding region, via a radial movement. Arrow T in FIG. 2*b* and FIG. 3*c* indicate the direction of movement of ring segments 3*a*. Lifting and lowering device 4 is therefore free to receive a new ring segment 3*a*, which is stored, for example, in another room 5*b*, used as a storage room, and used as a temporary replacement for ring segment 3*a*, which is subjected to redesign. For this purpose, lifting and lowering device 4 only has to be moved in the vertical direction so that it is possible to push new ring segment 3*a* onto the lifting and lowering device from room 5*b*. This new ring segment 3*a* may finally be brought to the height of sales and presentation regions 1, 2, so that the horizontal rotational movement of annular region 3 may be resumed. This process may be performed outside of the opening hours of the sales and presentation area, or even during the opening hours due to the changing section 13 which is closed for public. Since the replacement of a ring segment 3*a* according to the procedure described is finished within a few minutes, it would also be conceivable to block off the affected section during this time, so that replacement of ring segments 3*a* may also be performed during the opening hours of the shopping mall.

It is further possible to replace, e.g., a ring segment 3*a* which during the day serves for sporting activities such as a squash field by, e.g., a gambling area used during night hours. This makes it possible to use areas of the shopping mall with higher capacity, and 24 hours a day, thereby increasing total revenues of the overall shopping mall. In this case the respective ring segment 3*a* would have opening hours so that the ring segment will be cleared from customers outside the opening hours which makes its replacement easy.

The advantages of the possible rebuilding of ring segments 3*a* outside of publicly accessible sales and presentation regions 1, 2 are that, among other things, rebuilding, which is time-intensive in some circumstances, may be performed without having to close the sales and presentation area. The rebuilding work particularly avoids dust and noise problems for surrounding sales and presentation regions 1, 2. The access to rooms 5*a* may also be designed in such a way that they are accessible to larger devices and/or equipment objects. Rooms 5*a* themselves may be equipped with cranes and machines of all types, so that the infrastructure necessary for rebuilding work is already provided.

In the changing section 13 of lifting and lowering devices 4, roof 8 of the sales and presentation area may be designed so that it may be opened up sometimes, as is indicated in FIGS. 2*b* and 3*c*. To produce the desired sound and light effects, centrally controlled public address systems having loudspeakers 9 and light facilities having movable spotlights 10, as well as multimedia projection devices, may be provided. For precise, vertical movements of loads and scenic design elements, point hoists 11 may also be provided. For suspending scenographic elements, as is known from theater technology, a stage loft 12 may be installed, which is positioned over sales and presentation regions 1, 2.

Therefore, by combining modern technology with theater elements, a shopping world is supplemented with different "adventure worlds". These "adventure worlds" may be continuously changed, so that the sales and presentation area is presented to the customers in a continuously changing appearance, through which effects of familiarity may be suppressed.

The invention claimed is:

1. A sales and presentation area having an essentially annular region, wherein said annular region is rotatably mounted in the horizontal direction, divided into ring segments able to be moved individually in the vertical direction, and set into horizontal rotational movement via drives during use of said ring segments by customers, a changing section along the path of said moving annular region which encompasses at least one of said ring segments during a standstill of said annular region, and which is kept inaccessible for customers from the exterior of said annular region, a lifting and lowering device which is provided beneath the changing section and over which said ring segments slide in the course of the rotational movement of said annular region and on which said ring segments rest during a standstill of said annular region for moving said ring segments in the vertical direction, and rooms below the sales and presentation area, wherein the rooms are radially outside of the annular region so that said ring segments are able to be pushed in a radial direction of the annular region into the rooms, if said lifting and lowering device is lowered from a standard height, wherein customers in the path of said annular moving region use a ring segment of said ring segments resting on the lifting and lowering device when the lifting and lowering device is at the standard height.

2. The sales and presentation area according to claim 1, wherein said rooms are positioned one below another under the sales and presentation area.

3. A shopping mall having a first annular region, wherein said first annular region is rotatably mounted in the horizontal direction, divided into ring segments able to be moved individually in the vertical direction, by a first lifting and lowering device, and set into horizontal rotational movement via drives during use of said ring segments by customers;

a first changing section along the path of said first moving annular region encompassing at least one of said ring segments during a standstill of said first annular region, the changing section being kept inaccessible for customers from a first exterior of said first annular region; and a second annular region located adjacent to said first annular region, said second annular region having a second lifting and lowering device, said first and second annular regions sharing the first changing section, the first changing section being kept inaccessible for customers from an exterior of said second annular region.

* * * * *